US006640720B1

(12) United States Patent
Biserød

(10) Patent No.: US 6,640,720 B1
(45) Date of Patent: Nov. 4, 2003

(54) TRANSLATION AND LOCKING MECHANISM IN MISSILE

(75) Inventor: Hans B. Biserød, Raufoss (NO)

(73) Assignee: Nammo Raufoss AS, Raufoss (NO)

( * ) Notice: Subject to any disclaimer, the term of this patent is extended or adjusted under 35 U.S.C. 154(b) by 0 days.

(21) Appl. No.: 10/009,283

(22) PCT Filed: Jun. 2, 2000

(86) PCT No.: PCT/NO00/00190

§ 371 (c)(1),
(2), (4) Date: Apr. 9, 2002

(87) PCT Pub. No.: WO00/75600

PCT Pub. Date: Dec. 14, 2000

(30) Foreign Application Priority Data

Jun. 4, 1999 (NO) ..... 19992739
Oct. 21, 1999 (NO) ..... 19995141

(51) Int. Cl.[7] ..... F42B 15/00
(52) U.S. Cl. ..... 102/377; 102/378; 244/3.26
(58) Field of Search ..... 102/374, 376, 102/377, 378; 244/3.24, 3.26

(56) References Cited

U.S. PATENT DOCUMENTS 2,935,946 A * 5/1960 Gallo et al.
2,936,710 A * 5/1960 Bollay
3,071,404 A * 1/1963 Van Hove
3,086,467 A * 4/1963 Gallagher et al.
3,160,098 A * 12/1964 Schulze et al.
3,256,818 A * 6/1966 Pilcher, II
3,705,550 A * 12/1972 Long ..... 60/254
3,754,507 A 8/1973 Dillinger
4,519,317 A * 5/1985 Rosenberg ..... 102/521
4,573,412 A 3/1986 Lovelace et al. ..... 102/374
4,628,821 A * 12/1986 Madderra et al. ..... 102/517
4,964,339 A 10/1990 Bastian et al. ..... 102/376
5,189,248 A 2/1993 Deffayet et al. ..... 102/386
5,892,217 A * 4/1999 Pollin ..... 244/3.3

FOREIGN PATENT DOCUMENTS

DE 2234302 2/1973
EP 0 151 676 8/1985

OTHER PUBLICATIONS

Gernandt; NASA TECH BRIEF; Self Sealing Disconnect for Tubing; Jan. 1964; Brief 63–10226; 2 pages.*

* cited by examiner

*Primary Examiner*—Stephen M. Johnson
(74) *Attorney, Agent, or Firm*—Knobbe, Martens, Olson & Bear, LLP

(57) ABSTRACT

A translation and locking mechanism for a projectile that is lying in a standby position within a rocket motor in a missile, wherein the projectile is translated with respect to the rocket motor by means of a pyrotechnic charge before the rocket motor is ignited. The rear end of the projectile includes at least one radially spring biased lock and the front part of the rocket motor includes an internal circumferential groove that the at least one lock snaps into when the at least one lock is translated to the groove.

12 Claims, 2 Drawing Sheets

TRANSLATION AND LOCKING MECHANISM IN MISSILE

RELATED APPLICATIONS

This application claims the benefit of the Norwegian applications 1999 2739 filed Jun. 4, 1999 and 1999 5141 filed Oct. 21, 1999 and the international application PCT/NO00/00190 filed Jun. 2, 2000. This application is related to co-pending applications "RELEASE MECHANISM IN A MISSILE" Ser. No. 10/009,281, "RETARDING AND LOCK APPARATUS AND METHOD FOR RETARDATION AND INTERLOCKING OF ELEMENTS" Ser. No. 09/980,948, and "PROPELLING DEVICE FOR A PROJECTILE IN A MISSILE" Ser. No. 09/980,944 all filed concurrently herewith.

The present invention relates to a translation and locking mechanism for a projectile that is lying in a standby position within a rocket motor in a missile, where the projectile is translated in respect of the rocket motor by means of a pyrotechnic charge before the rocket motor is initiated,

DESCRIPTION OF THE RELATED ART

The translation and locking mechanism according to the invention is developed for use in missiles, and in particular, but not exclusively, in rocket accelerated penetrators. Rocket accelerated penetrators are often kept in their storing and standby state with the main parts thereof not assembled. This means the part having control fins, the fin cone, and the rocket motor proper is assembled to the penetrator at the moment before the missile is launched from the launcher. The penetrator, which is in form of an arrow like body having substantial mass, is lying in standby position in a translation tube within the rocket motor and with the pointed end thereof supported in the control fin part. How the assembly operation happens is described in detail in the U.S. patent application no. 09/980,948.

During launching preparations the penetrator is translated through the translation tube and the control fin part and the rear end of the penetrator is interlocked to the control fin part immediately before the rocket motor is ignited. It is common practise that the rocket motor is separated from the penetrator during the flight thereof as soon as the rocket motor is burned out and has lost its propelling force. It is the mechanism for the translation of the penetrator, and more generally the projectile, and locking of the rear end of the projectile to the rocket motor the present application deals with.

SUMMARY OF THE INVENTION

According to the invention, a translation and locking mechanism of the introductorily described kind is provided, which is distinguished in that the rear and of the projectile and the front and of the rocket motor comprises respectively either at least one radially spring biased locking means or a circumferential groove that the at least one locking means snaps into when the at lent one locking means and the groove are aligned.

In a first alternative embodiment, it is the rear end of the projectile tat includes the at least one radially spring biased locking means and it is the front part of the rocket motor. that includes the circumferential groove that the at least one locking means snaps into when the at least one locking means is translated to and is aligned with the groove, which at least one locking means is spring biased radially outwards and the groove is an internal circumferential groove in the front part of the rocket motor.

In a second embodiment, it is the front part of the rocket motor that includes the at least one radially spring biased locking means and it is the rear end of the projectile that includes the circumferential groove that the at least one locking means snaps into when the groove is translated to and is aligned with the at least one locking means, which at least one locking means is spring biased radially inwards and the groove is an external circumferential groove in the rear part of the projectile.

In one embodiment, the rear part of the projectile can be an integrated power piston that follows the projectile during the flight thereof.

In a second embodiment, the power piston can be releaseable from the projectile together with the rocket motor.

As one among several alternatives, each locking means can be in form of a locking lug, or retainer, that tends to radial outwards directed motion by means of a spring which is located underneath the retainer. The configuration of the retainer and the number thereof can vary according to desire.

The locking means can, as one of the alternatives, be like a C-formed locking ring of the "piston ring type" and is then one single part that has both the inherent spring bias outwards and have the same locking function as a retainer in the groove.

It is to be understood that the translation and locking mechanism has performed the mission thereof before the rocket motor is initiated and launched.

Other and further objects, features and advantages will appear from the following description of one for the time being preferred embodiment of the invention, which is given for the purpose of description, without thereby being limiting, and given in context with the appended drawings where:

DETAILED DESCRIPTION OF THE PREFERRED EMBODIMENTS

The description is related to a missile in form of a penetrator and a rocket motor, but the invention is not limited to a penetrator only. Any projectile, with or without warhead, can together with a rocket motor use the translation and locking mechanism according to the invention.

Figure 1:
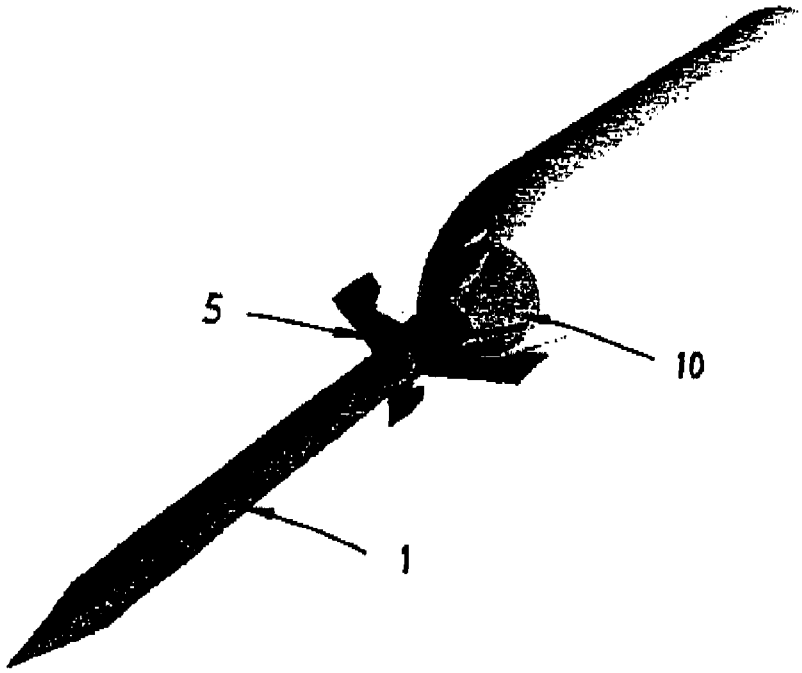
FIG. 1 shows schematically a rocket accelerated penetrator.

We firstly refer to FIG. 1 that illustrates a missile in flight. The missile comprises a penetrator 1, a control fin part 5 and a rocket motor 10 as main components. The penetrator 1 is an arrow like body having substantial mass, preferably of tungsten or depleted uranium. A penetrator is a projectile omit warhead and do achieve its destructive effect owing to the kinetic energy thereof.

Figure 2:
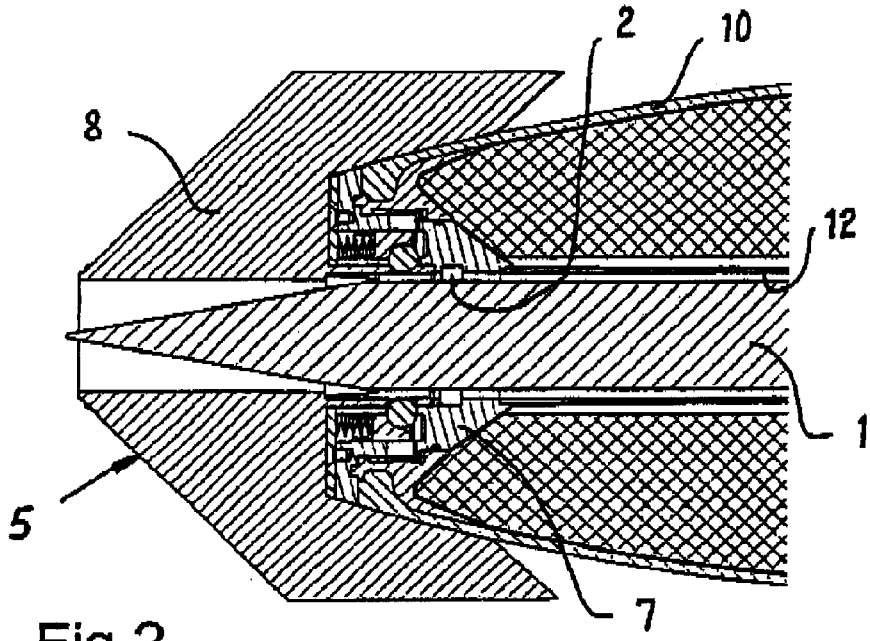
FIG. 2 shows the front and of a penetrator in the storing position thereof inside a control fin part and a rocket motor.

FIG. 2 shows the forward pointed end of the penetrator 1 in the way it is lying in standby position in the control fin part 5 and within a translation tube 12 centrally located in the rocket motor 10 during storage until launching, or ready for launching from a launching pipe or launcher (not shown).

The penetrator 1 is held axially in place within the rocket motor 10 by a closure means (not shown) having a cap that can be opened or burst away.

The reference number 8 refers to one of four control fins that are located circumferentially about a centre and having equal pitch or angular distance B each other. The number of fins 8 can vary according to desire. The rocket motor 10 is, as mentioned releasable fixed to the control fin part 5. The rocket motor 10 is released and does separate from the control fin part 5 during the flight of the missile when a propellant charge within the rocket motor 10 is burned out and retardation occur.

The propulsion means for translation of the projectile through the translation tube within the rocket motor is described in closer detail in U.S. patent application no. 09/980,944. The release mechanism between the control fin part and the rocket motor is described in closer detail in U.S. patent application no. 10/009,281. Only to be described here is that the rocket motor 10 includes a forward closure 7 that has an internal circumferential groove 2 and the forward closure 7 with the groove 2 comprises a part of the present locking mechanism.

Figure 3:
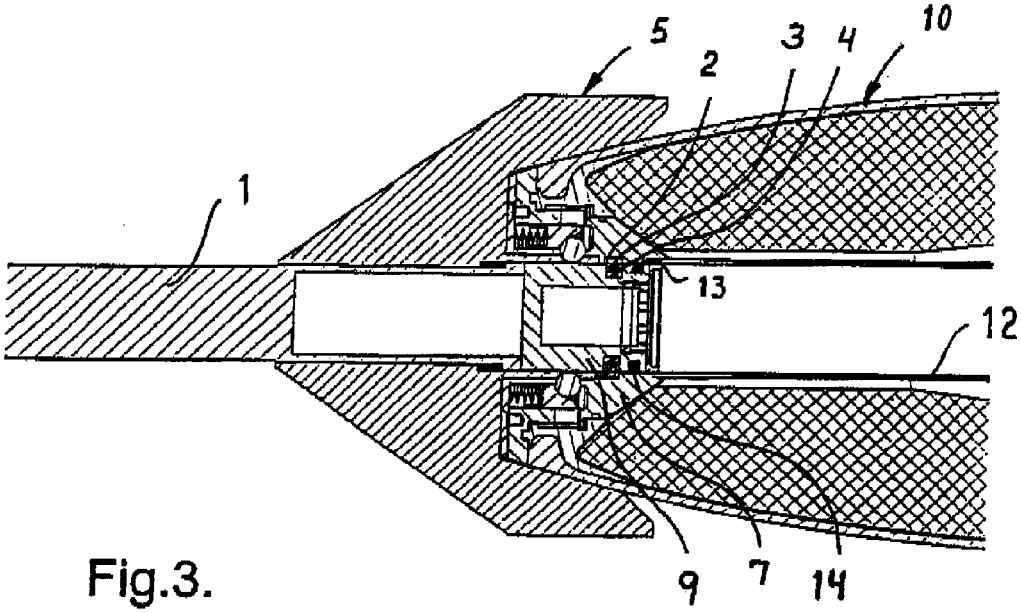
FIG. 3 shows the rear end of a translated penetrator after the penetrator has been interlocked to a control fin part and a rocket motor.

FIG. 3 shows the rear end of the penetrator 1 when the penetrator is translated through the control fin part 5. The rear end of the penetrator 1 interlocks to the control fin part 5 after the translation. How this happens is described in closer detail in U.S. patent application no. 09/980,948.

The penetrator 1 is, as mentioned, lying in a translation tube 12 within the rocket motor 10 and is translated by means of a pyrotechnic charge that is received within a power piston 9. The pyrotechnic charge is fired by a squib that initiates the entire launching operation. The squib is lying rearmost within the power piston and ignites the larger pyrotechnic charge located within the power piston 9. The power piston 9 has two external recesses 6. Each recess 6 receives a spring 4 and a locking lug 3, or retainer. The spring 4 exert a radially outwards directed bias against the retainer 3 that in turn urges against the translation tube 12. In the rear end of the power piston 9 is an external circumferential groove 13 recessed, which groove receives an O-ring 14 that provides axial sealing between the external surface of the power piston 9 and the internal surface of the translation tube 12.

When the penetrator 1 is completely translated within the translation tube 12, the spring biased retainers 3 are popped into the internal groove 2 in the forward closure 7 and is thus locking the power piston 9 to the forward closure 7 and in turn to the front end of the rocket motor 10.

Figure 4:
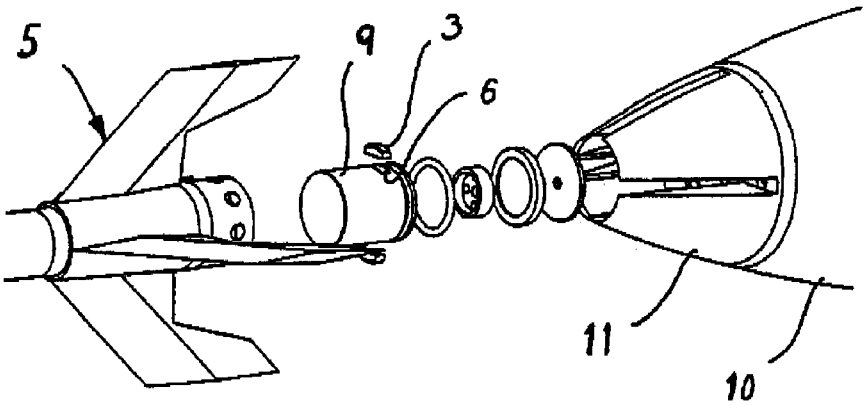
FIG. 4 shows schematically and in exploded view the locking mechanism in the rocket accelerated penetrator.

FIG. 4 shows the missile with the parts apart. After that the release mechanism has performed the mission thereof, it is the penetrator 1 and the control fin part 5 that continue the flight while the remaining parts are falling off. The reference number 11 shows an ogive that serves as a flow element in the transition between the control fins 8 and the front end of the rocket motor 10. The ogive 11 also restrict relative rotation between the penetrator 1 and the rocket motor 10. After the rocket motor 10 is burnt out, the ogive has carried out its mission and does release from the control fin part 5 together with the rocket motor 10 proper, the forward closure 7 and the power piston 9.

In the illustrated embodiment is the circumferential groove 2 provided in the forward closure 7 and the retainers 3 arranged on the power piston 9. As an equivalent alternative (not shown) can the retainers be arranged internally of the forward closure 7 and the groove be provided externally on the power piston 9.

As a not illustrated alternative, the rear end of the projectile 1 can be an integrated power piston that follows the projectile 1 during the flight thereof. Then the locking means, in stead of locking to the front part of the rocket motor 10, will lock to the rear and central extension of the control fin part 5.

In the shown embodiment, two retainers 3 are indicated, and both retainers 3 are lying spring biased in their respective recesses in the power piston 9. As a not illustrated alternative, the locking means can be in form of a C-formed lock ring of the "piston ring" type and is then one single part that has both inherent spring bias outwards and has the same locking function as a retainer in the groove 2. In stead of the recesses 6 in the power piston 9, a circumferential groove that the C-ring is lying in will be present, and the ring is urging outwards against the internal surface of the translation tube 12 all the way until the ring hits the groove 2 in the forward closure 7 or a corresponding groove in the central extension of the control fin part 5.

What is claimed is:

1. A translation and locking mechanism for a projectile that is lying in a standby position within a rocket motor in a missile, where the projectile is translated with respect to the rocket motor by means of a pyrotechnic charge before the rocket motor is initiated, wherein the rear end of the projectile and the front end of the rocket motor comprise respectively either at least one radially spring biased lock or a circumferential groove that the at least one lock snaps into when the at least one lock and the groove are aligned.

2. The translation and locking mechanism of claim 1, wherein the rear end of the projectile includes the at least one radially biased lock and the front part of the rocket motor includes the circumferential groove that the at least one lock snaps into when the at least one lock is translated to and is aligned with the groove, wherein the at least one lock is spring biased radially outwards and the groove is an internal circumferential groove in the front part of the rocket motor.

3. The translation and locking mechanism of claim 1, wherein the front part of the rocket motor includes the at least one radially spring biased lock and the rear end of the projectile includes the circumferential groove that the at least one lock snaps into when the groove is translated to and is aligned with the at least one lock, wherein the at least one lock is spring biased radially inwards and the groove is an external circumferential groove in the rear part of the projectile.

4. The translation and locking mechanism of claim 1, wherein the rear end of the projectile is a power piston.

5. The translation and locking mechanism of claim 4, wherein the power piston is releasable together with the rocket motor.

6. The translation and locking mechanism of claim 1, wherein the lock is a locking lug or retainer.

7. The translation and locking mechanism of claim 1, wherein the lock comprises a C-formed piston locking ring.

8. The translation and locking mechanism of claim 1, wherein the projectile is a penetrator.

9. A missile comprising:

a rocket motor defining a translation tube;

a projectile positioned within the translation tube; and a power piston positioned within the translation tube, wherein the power piston, when activated, urges the projectile along and out of the translation tube and wherein the power piston includes a spring biased locking mechanism that engages with the front of the rocket motor when the projectile has been urged out of the translation tube to thereby retain the power piston in the rocket motor.

10. The missile of claim 9, wherein a groove is formed in the front of the rocket motor into which the spring biased locking mechanism is urged.

11. The missile of claim 10, wherein the spring biased locking mechanism is biased radially outward.

12. The missile of claim 9, wherein the power piston is activated by a pyrotechnic charge.

* * * * *